US007070070B2

(12) United States Patent
Michelson et al.

(10) Patent No.: US 7,070,070 B2
(45) Date of Patent: Jul. 4, 2006

(54) CONTENT LIFTING AND REMOVING CONTAINER ASSEMBLY

(75) Inventors: Gary K. Michelson, 438 Sherman Canal, Venice, CA (US) 90291; Wiley Alan Kittrell, Fremont, CA (US)

(73) Assignee: Gary K. Michelson, Los Angeles, CA (US)

( * ) Notice: Subject to any disclaimer, the term of this patent is extended or adjusted under 35 U.S.C. 154(b) by 364 days.

(21) Appl. No.: 10/401,460

(22) Filed: Mar. 27, 2003

(65) Prior Publication Data

US 2005/0072784 A1 Apr. 7, 2005

Related U.S. Application Data

(60) Continuation of application No. 09/991,845, filed on Nov. 19, 2001, now Pat. No. 6,561,388, which is a continuation of application No. 09/489,083, filed on Jan. 21, 2000, now Pat. No. 6,318,602, which is a division of application No. 09/189,754, filed on Nov. 10, 1998, now Pat. No. 6,257,459.

(51) Int. Cl.
*G01F 11/042* (2006.01)

(52) U.S. Cl. ..... 222/322; 222/405

(58) Field of Classification Search ..... 222/322, 222/405, 392

See application file for complete search history.

(56) References Cited

U.S. PATENT DOCUMENTS

| | | | |
|---|---|---|---|
| 522,693 | A | 7/1894 | McLaughlin |
| 1,468,152 | A | 9/1923 | Hemstreet |
| 1,718,277 | A | 6/1929 | Crowell |
| 2,281,251 | A | 4/1942 | Simmons |
| 2,684,790 | A | 7/1954 | Porter |
| 3,053,410 | A | 9/1962 | Eaddy |
| 4,471,892 | A | 9/1984 | Coleman |
| 4,684,042 | A | 8/1987 | Strickler et al. |
| 4,832,968 | A | 5/1989 | Forage et al. |
| 5,626,266 | A | 5/1997 | Michelson |

FOREIGN PATENT DOCUMENTS

| | | |
|---|---|---|
| DE | 866313 | 2/1953 |
| FR | 840569 | 4/1939 |
| FR | 2471322 | 12/1979 |
| GB | 438239 | 11/1935 |
| GB | 638762 | 10/1947 |

*Primary Examiner*—Michael Mar
*Assistant Examiner*—M A Cartagena
(74) *Attorney, Agent, or Firm*—Martin & Ferraro, LLP

(57) ABSTRACT

An improved lifting assembly for removing contents from containers consistent with mechanized containerizing operations are disclosed. The lifting assembly of the present invention comprises a support plate for lifting contents coupled to the top of a container by a connector.

37 Claims, 18 Drawing Sheets

CONTENT LIFTING AND REMOVING CONTAINER ASSEMBLY

This is a continuation of application Ser. No. 09/991,845, filed Nov. 19, 2001, now U.S. Pat. No. 6,561,388, which is a continuation of Ser. No. 09/489,083, filed Jan. 21, 2000, now U.S. Pat. No. 6,318,602, which is a division of application Ser. No. 09/189,754, filed Nov. 10, 1998, now U.S. Pat. No. 6,257,459 all of which are incorporated herein by reference.

BACKGROUND

Field of the Invention

Description of the Related Art

It has long been a recognized problem that foods and other products having a thick consistency, such as canned meats, including dog or cat foods, tomato paste, refried beans, and many non-food material such as grease, spackling paste, putty, etc., are difficult to remove from a container, be it a can, jar, or plastic tub. Other items such as olives and pickles by way of example, are difficult to remove from their containers as they are immersed in a fluid medium such that the fluid must first be drained, or the items individually lifted to access them. Thus, once the container is opened it is necessary to use a spoon or other utensil to scoop out the from the container. Alternatively, it is necessary to use a knife to cut around the sides of the product to break the seal and cohesiveness between the product and the sides of the container, yet this will fail to address the problem of contents adhering to the bottom and the vacuum that is created as the contents are lifted.

Since it may be desirable to use only a portion of the contents of a container at one time, it should be recognized that it would be undesirable to destroy the container in the process of removing a portion of the contents, such as when opening both ends of the container in order to push out the contents of the container.

Additionally, it is recognized that it is not always possible to have available the proper tools or utensils, e.g., a can opener, for opening the container. This inconvenience is made worse by the fact that if a can opener is available, it will likely become soiled by the contents of the container when used. Therefore, it would be desirable to be able to open a container without using any tools or utensils. Similarly, it would be desirable to be able to open a container without contacting the contents. Further, it would be desirable to be able to remove the contents without the need to resort to utensils.

Finally, it would be desirable to be able to restore an airtight seal to the container after opening the container to protect any unused portion of the contents.

However, it is important that any such improvements in container technology conform to existing canning procedures, machinery and assembly lines so as to incur either no or minimal additional costs in the implementation of these improved methods and that these changes not significantly slow down a high-speed mechanized containerizing procedures.

SUMMARY OF THE INVENTION

The present invention is directed to a container constructed with a lifting assembly for lifting contents from within the container. The lifting assembly comprises a connector that attaches at one end to a support plate situated at the bottom of the container and that extends substantially to the top of the container. The contents of the container, such as dog or cat food or any other material having a similar consistency, surround the connector and covers the support plate. The connector is attached at its other end to the underside of the top of the container. The container is then sealed in a conventional manner.

When it is desired to open the container, at least a portion of the top is removed from the container. As the top is removed, the connector attached to the underside of the top is lifted, thereby lifting the lower support plate and the contents of the container situated above the lower support plate. The desired amount of the contents of the container for removal may then be removed. In some embodiments, the lid or a separable portion of the top may even be used as a tool for pushing or cutting the contents.

In a preferred embodiment, the top of the container is provided with a ring pull tab, which is bent upward to break the seal along a prescored line in the top cover and then pulled back to remove at least a portion of the top from the container without the use of additional tools or utensils.

The connector may be flexible, or inflexible, and may include a string or wire, but the connector may also be a rod or a hollow tube linked to the lower support plate. A replacement cover may be provided for resealing the container, and may also have means for engaging the connector such that when it is desired to remove additional contents of the container at a later date, the replacement cover would be grasped and pulled up to lift the connector and, in turn, the contents remaining in the container.

The present invention provides an easy to use and practical improved means for content removal which means is readily compatible with present day commercial high speed containerizing machinery and procedures. After insertion of the support plate and connector device into the container, the contents may be inserted therein. When the top cover is then applied to seal the contents therein, the connector is automatically engaged thereby completing the assembly of the content lifting assembly such that it is ready to use upon the subsequent opening of the container.

OBJECTS OF THE INVENTION

It is an object of the present invention to provide an improved container construction that is easy to use;

It is another object of the present invention to provide an improved container construction with a content removal assembly that is easy to assemble;

It is another object of the present invention to provide an improved container construction with a content removal assembly that is inexpensive to manufacture;

It is another object of the present invention to provide an improved container construction with a content removal assembly and manner of assembly that is compatible with existing food containerizing machinery and procedures;

It is another object of the present invention to provide an improved container construction with a content removal assembly that is reliable;

It is another object of the present invention to provide an improved container construction with a content removal assembly that provides for the thorough emptying of the container;

It is yet another object of the present invention to provide a container which may be opened without the use of extrinsic tools or utensils;

It is another object of-the present invention to provide a container which may be completely emptied without the use of tools or utensils;

It is also an object of the present invention to provide a container that prevents contact between the hand or other body part of a user with the contents therein;

It is a further object of the present invention to provide a container which may be resealable for short term storage of the unused portion of the contents; and It is another object of the present invention to provide a container which may be recyclable.

These and other objects of the present invention will be apparent from a review of the detailed description of the drawings and the accompanying drawings, which are provided by way of example and not limitation.

BRIEF DESCRIPTION OF THE DRAWINGS

A more complete understanding of the present invention may be had by reference to the following detailed description when taken in conjunction with the accompanying drawings, wherein.

DETAILED DESCRIPTION OF THE DRAWINGS

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In addition, several distinct shapes or embodiments for the container assembly of the present invention are possible and various features taught in regard to a specific embodiment are not limited to that embodiment but may be useful with other embodiments and other means for achieving the same results as anticipated and claimed as part of the present invention illustrated in the figures described below.

Figure 1:
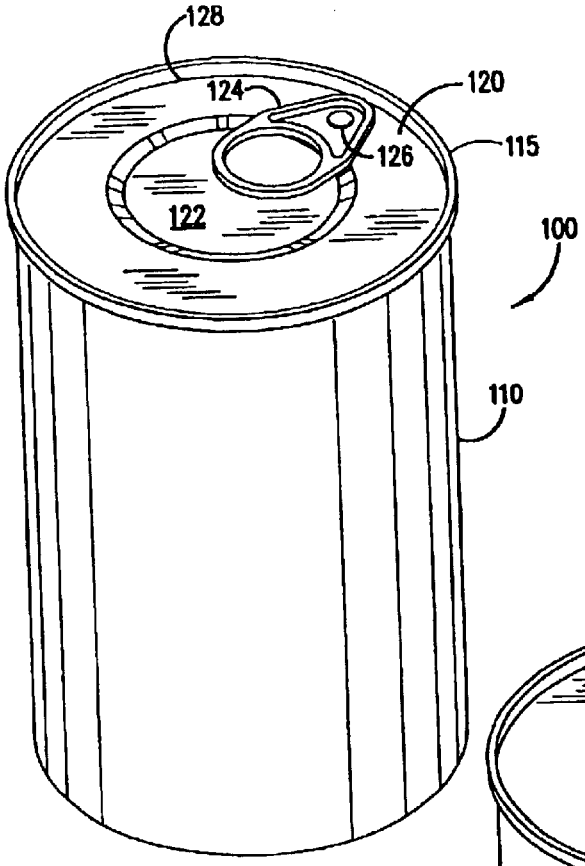
FIG. 1 is a top perspective side view of a first embodiment of the container of the present invention.

Referring now to FIG. 1, a top perspective side view of a first embodiment of the container of the present invention is shown. The first embodiment container, generally referred to by the number 100, has a cylindrical side wall 110 and is covered by a top 120 joined to the side wall 110 by a rolled edge 115. Top 120 may have, but need not have, a depression 122 to allow easy finger access to pull-ring 124 which is not requisite to the present invention, but is preferred, and which is attached to top 120 through a ring attachment device 126. The ring attachment device 126 protrudes from top 120, and includes a shaft passing through a base portion of ring 124 and a head portion to retain the base of ring 124 to the top or cover 120. Top 120 also has a scored circumferential feature separation line 128. When pull ring 124 is lifted upward it leverages against ring attachment point 126 and drives the base edge of the pull ring 124 against and downward onto or adjacent separation line 128, driving this portion of the top away from the rolled edge 115 and causing it to separate. As the ring 124 is further lifted and pulled back, that portion of the top contained within the separation line 128 is then separated from the remaining rolled edge 115 of the top 120 allowing a lid or portion of the top to be separated from the rest of the container 100.

Figure 1A:
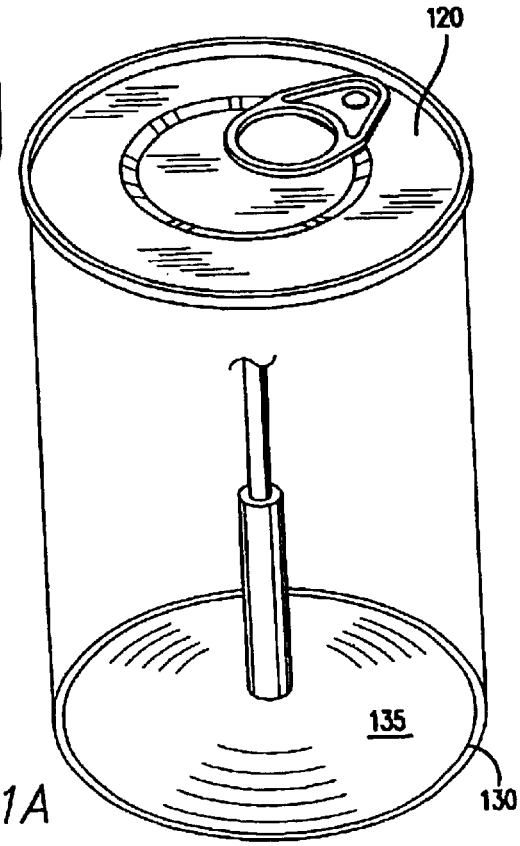
FIG. 1A is a partial cut-away view of FIG. 1 revealing a portion of the content lifting mechanism of the first embodiment of the present invention.

FIG. 1A shows the cylindrical side wall 110 of the container 100 in outline only to reveal a portion of the content lifting mechanism within the container 100. A support plate 135 is illustrated proximate to, situated upon, and covering almost all of a bottom 130 of the container 100. As illustrated, extending upward through the center of the container 100 from the support plate 135 is a connector, generally designated herein by the reference numeral 132, having a mechanically interlocking articulation between the top and the support plate, which connects the support plate 135 to the underside or interior surface of the top 120.

It should be understood that the phrase "mechanically interlocking articulation" as used throughout this application and in the claims, is defined as a mechanical connection of cooperatively engaging elements in close tolerance or interlocked, such as but not limited to the connections illustrated in the drawings, including but not limited to a ball and socket snap fit, a pop-through connection such as when a larger part passes through a smaller opening having a flange or waist, and either the larger part (male) is collapsible or the smaller part (female) is expandable or the larger part extends through a cutout or key-way and is then retained by being rotated from alignment to the key way. The phrase "mechanically interlocking articulation" specifically does not include a single hook and a single loop connection or an exclusively adhesive bond.

Figure 1B:
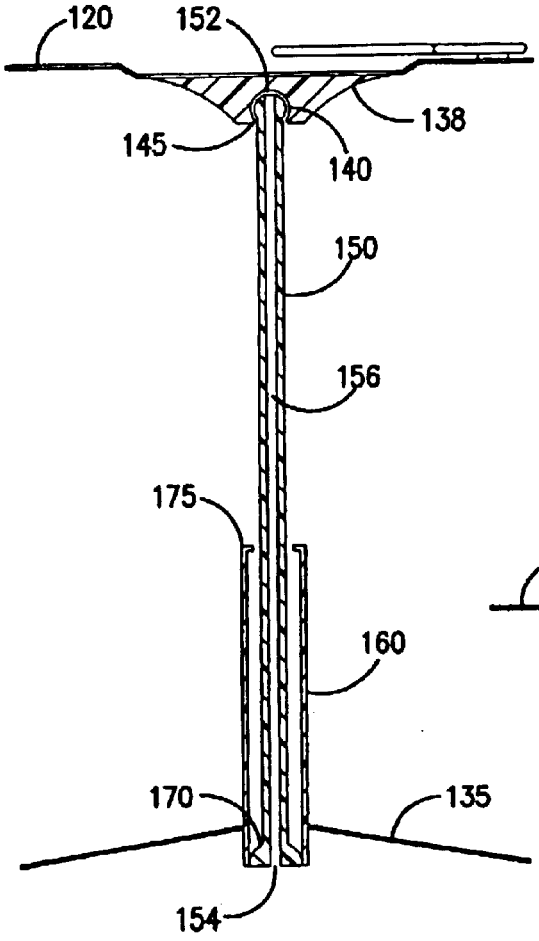
FIG. 1B is a side elevational cross-section through the content lifting mechanism of the first embodiment of FIG. 1A.

FIG. 1B is a side view of the mechanism of FIG. 1A in cross-section and shows an articulating anchor member 138 secured to and extending downward from the top 120. The articulating anchor member 138 includes a female socket 140 therein which has mechanically interlocking articulation, by snap fit, with a ball end 145 of a connector rod 150. Connector rod 150 is preferably hollow with a top opening 152 and a bottom opening 154, forming an air channel 156 to allow for the passage of air through the connector rod 150 from above the contents of the container (not shown) to below the support plate 135 upon opening. Connector rod 150 is seen to have mechanically interlocking articulation with and is partly contained within a lower connector piece 160. The connector rod 150 terminates in a foot 170. A portion of connector rod 150 is, therefore, free to move up and down within the lower connector piece 160, limited in upward movement by the foot 170 contacting a retaining flange 175 at the upper end of the lower connector piece 160. Because of the flat aspect of the bottom surface of the foot 170 and its fit within the lower connector piece, the connector rod 150 tends to stand erect and substantially centered within the container 100. As discussed, foot 170 in cooperation with the flange 175 of the lower connector piece 160 restrains connector rod 150 from exiting out of the top of lower connector piece 160.

For assembly, connector rod 150 is preferably inserted through the underside of the lower connector piece 160 and then these two parts, which form the contents lifting mechanism, are placed into the container 100 to be filled. The contents are then placed within the container 100 and the top 120 is then snapped into place, causing socket 140 to exhibit mechanically interlocking articulation with the ball end 145 of the connector rod 150 prior to the edge 115 of top 120 being rolled around the top surface of the container wall 110. To prevent the air channel 156 through the connector rod 150 from becoming included with material being packed into the container 100, a vent hose may be in place over assembly 150 and 160 while the container is being filled.

Figure 1C:
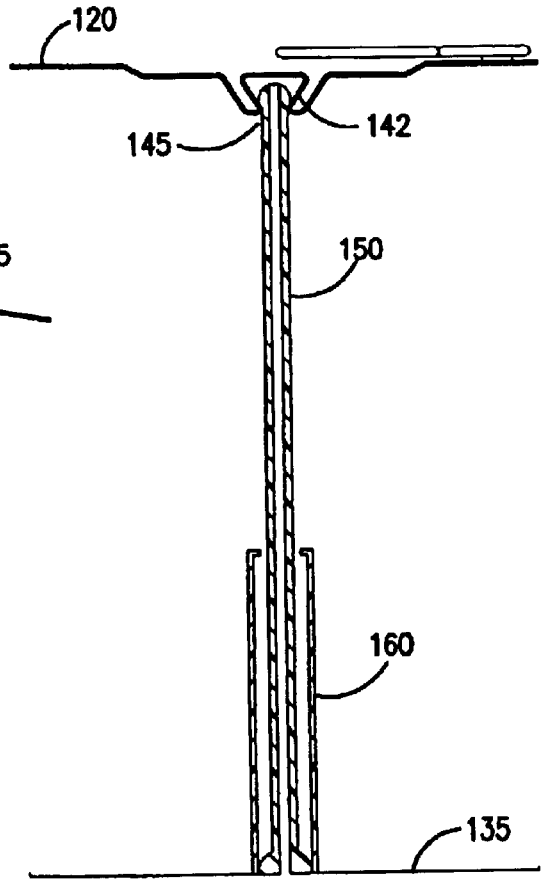
FIG. 1C is a side elevational cross-section through a variation of the first embodiment of the content lifting mechanism of FIG. 1A.

FIG. 1C shows an alternative embodiment to the mechanism of FIG. 1B, differing in that the ball end 145 of the connector rod 150 now has mechanically interlocking articulation with a stamped female socket 142 formed out of the top cover 120 material itself.

Figure 1D:
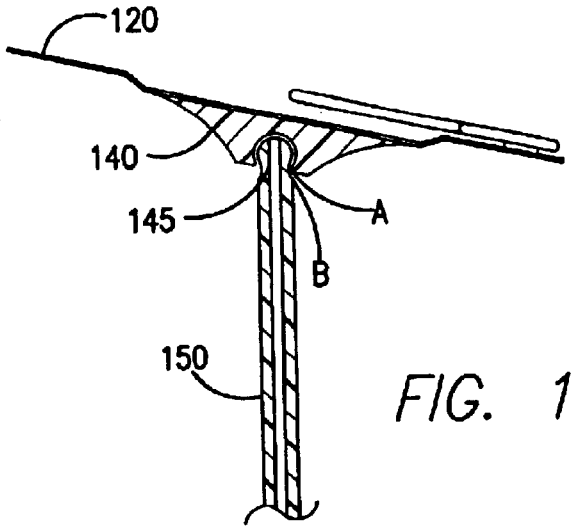
FIG. 1D is a detail cross-section of a side view of a portion of the first embodiment of the mechanism as shown in FIG. 1B.

FIG. 1D shows how the male/female snap fit connector of FIG. 1B allows for the tilt of the top 120 relative to the container 100, which is necessary to separate the top from the container using the proper technique. It can be seen that the female socket 140 of the articulating anchor member 138, attached to the underside of the top 120, is free to rotate on the ball end 145 of connector rod 150. It can also be appreciated that the downwardly displaced portion of the female socket 140, designated herein by the reference character A, can be levered against a point B at the junction of the ball end 145 and the remainder of the connector rod 150 so as to separate the top 120 from the connector rod 150 if desired.

Figure 1E:
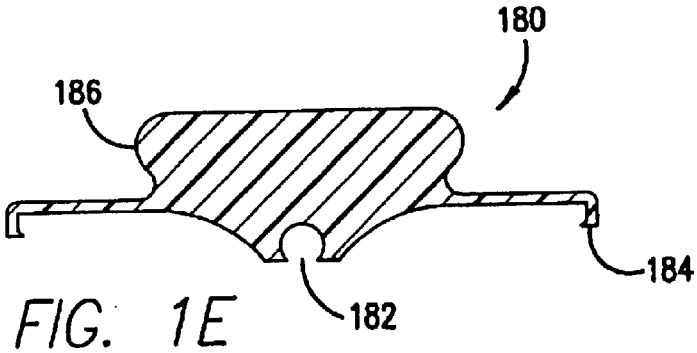
FIG. 1E is a cross-sectional side view of a replacement cover for the first embodiment of the container of the present invention.
Figure 1F:
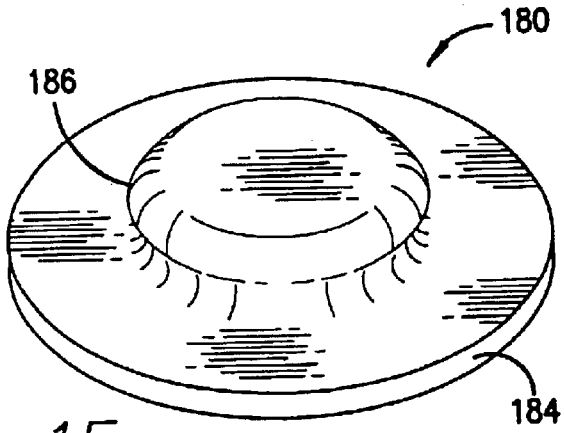
FIG. 1F is a top perspective view of the replacement cover of FIG. 1E.

FIG. 1E is a cut-away side view of a molded replacement cover, generally designated by the reference numeral 180, to fit over container 100, and be in mechanically interlocking articulation with the ball end 145 of connector rod 150 in the mechanism already described. FIG. 1F is a top perspective view of the replacement cover 180 of FIG. 1E. When only a portion of the contents of a container are used, it is useful to provide a way to preserve the remaining contents, such as one does when covering a bowl with plastic wrap or otherwise seals the contents from exposure to surrounding air. In the embodiment shown in FIGS. 1–1D, it is possible to detach the top 120 from the connector rod 150, as described hereinabove. It is then possible to place the replacement cover 180 of FIGS. 1E and 1F directly onto the container 100, allowing one to snap fit the female socket 182 onto the ball end 145 of the connector rod 150, allowing mechanically interlocking articulation thereabout. A circumferential flange 184 provides a seal about the container edge 1 15 along the upper portion of the circumferential side wall 110. Knob 186 is provided to facilitate removal of the replacement top 180 from container 100. As the replacement cover 180 is removed, the lifting assembly will be actuated through the connection to socket 182 and the contents will be raised again.

The replacement cover may include a surface for displaying advertising indicia, may be transparent at least in part, may form an airtight seal with a container, and may be reusable. Additionally, the replacement cover may also be used as a flying disc for recreation.

Figure 1G:
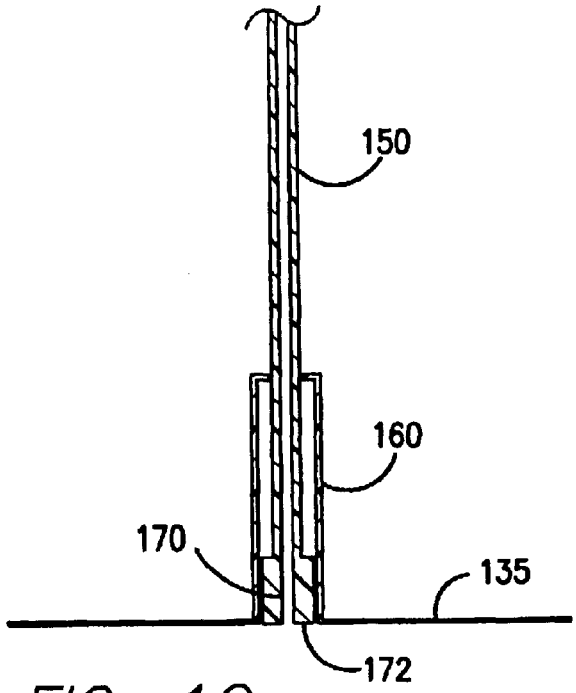
FIG. 1G is a detail of a cross-sectional side view of a variation of the first embodiment of a portion of the content lifting mechanism of the present invention.
Figure 1H:
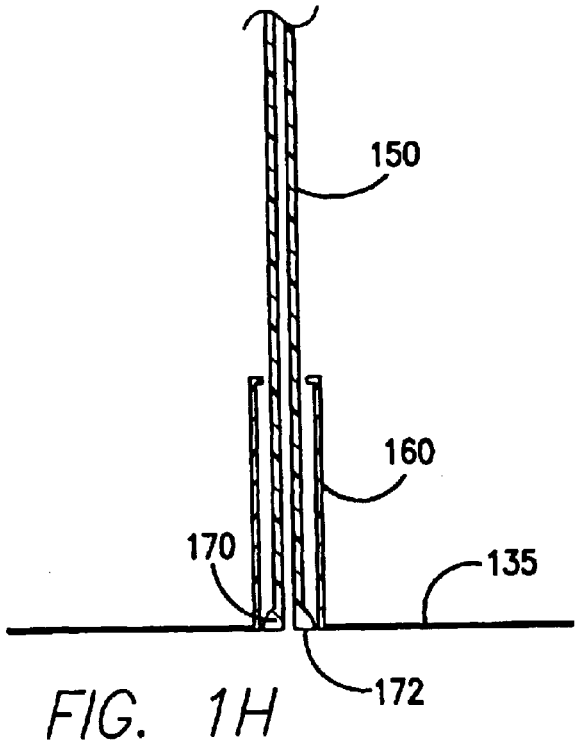
FIG. 1H a side view cross-section detail of a variation of the first embodiment of the lifting mechanism of the present invention.

FIG. 1G demonstrates an alternative design for the foot 170 of the connector rod 150, and its mechanically interlocking articulation within the lower connector piece 160. When compared to FIG. 1H it can be seen that the foot 170 shown in FIG. 1G is taller, more cylindrical, and in closer tolerance to the lower connector piece 160 than the foot shown in FIG. 1H. It should be understood, therefore, that the alternative embodiment illustrated in FIG. 1G provides for greater stability and better-ensures the upright centering of the connector rod 150 within the container 100. Alternatively, the mechanism illustrated in FIG. 1H, while providing for stability because of a flat surface 172, also allows for considerable wiggling of the connector rod 150, as may be helpful in allowing the top 120 to be pulled off the container 100 at an angle prior to actually raising the support plate 135.

With reference again to FIG. 1G, support plate 135 may be of an alternative shape to that shown in FIG. 1B, and may be of any shape so as to be useful for the intended purpose. Further, the support plate 135 may be solid or perforated, and of a diameter relevant to the container 100 sufficient to work for its intended purpose. The support plate 135, as well as the other parts which form the content lifting mechanism of the present invention, can be made of a variety of materials, so long as the materials are suitable for their intended purpose. These materials would include, but not be limited to, various metals appropriate for use in the canning industry and various plastics appropriate also for that purpose.

Figure 2:
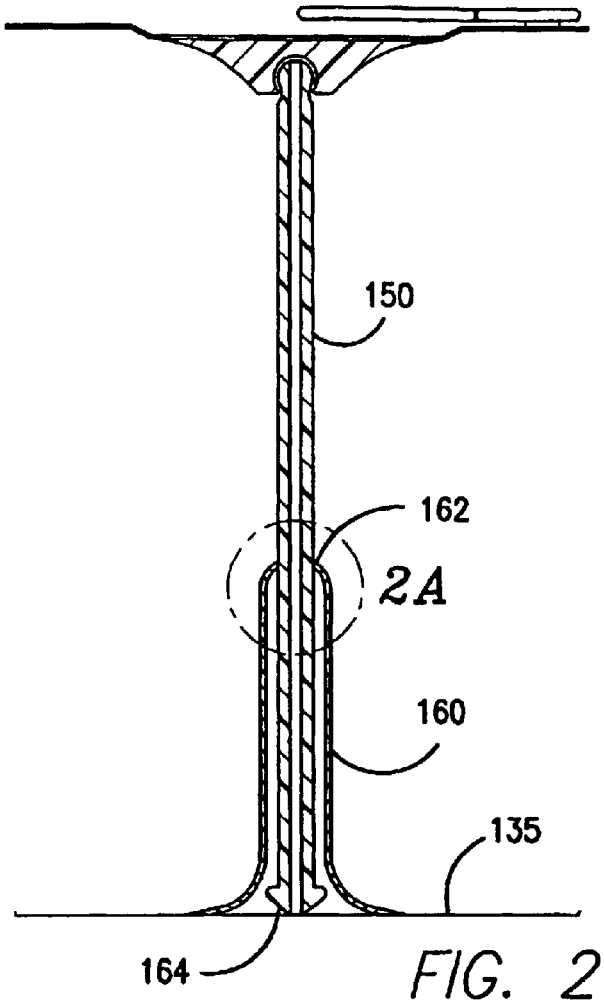
FIG. 2 is a side view cross-section of a variation of the first embodiment of the lifting mechanism of the present invention.
Figure 2A:
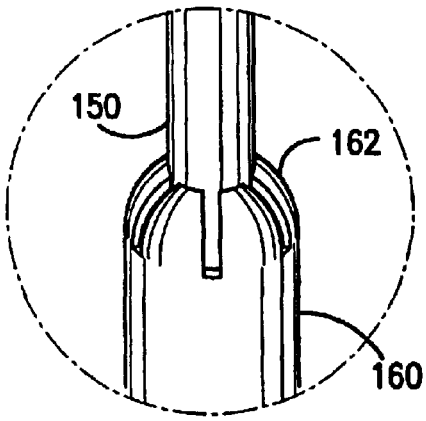
FIG. 2A is a magnified detail of a feature of the mechanism of FIG. 2.

FIGS. 2 and 2A illustrate an alternative embodiment to the mechanism shown in FIG. 1B, and differ therefrom most substantially in that the connector rod 150 can be inserted into the lower connector piece 160 through a flexible opening 162, illustrated in more detail in FIG. 2A, designed to receive a dart portion 164 of the connector rod 150.

Figure 3:
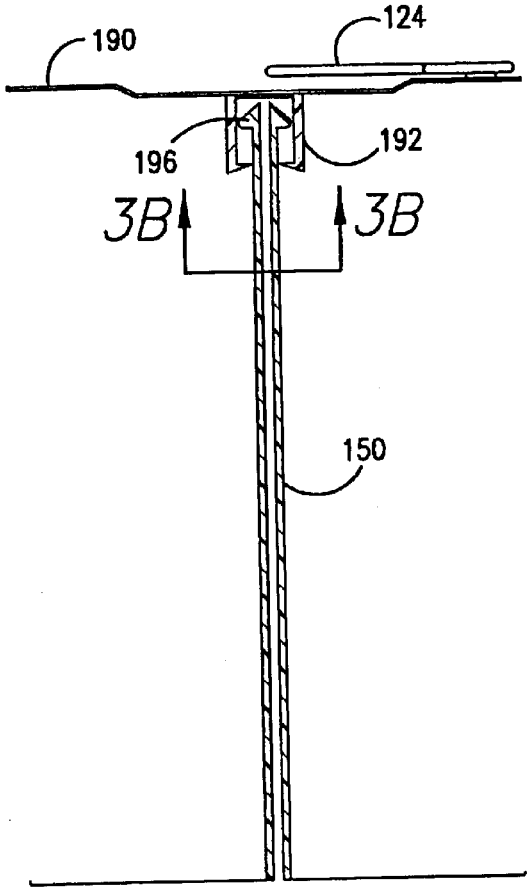
FIG. 3 is a cross-sectional side view of the second embodiment of the content lifting mechanism of the present invention.

With reference now to FIG. 3, a second embodiment of the present invention is illustrated. Alternative top 190 has an extended, downwardly-projecting female socket member 192. In this alternative embodiment of the present invention, connector rod 150 extends from the support plate 135 the length or height of the container 100, terminating in a dart 196 that is capable of a snap-fit mechanically interlocking articulation within the female receiving socket member 192 attachment to the top 190. The space or cavity within the female socket member, 192, i.e., the receiving socket, allows both up and down, as well as angular, motion necessary to permit the separation of the top 190 from the container 100 prior to the lifting of the contents by the support plate 135, which is articulated through the top by the connector rod 150. As with the previous example, while an air channel 156 is not obligatory, it offers the advantage of breaking the vacuum between the bottom 130 of the container 100 and the contents, which would be increased when trying to withdraw the contents from the container, much like a well fitting piston in a chamber. It is understood that the particulars could be reversed such that the socket extended from the connector and the dart component was part of the top.

Figure 3A:
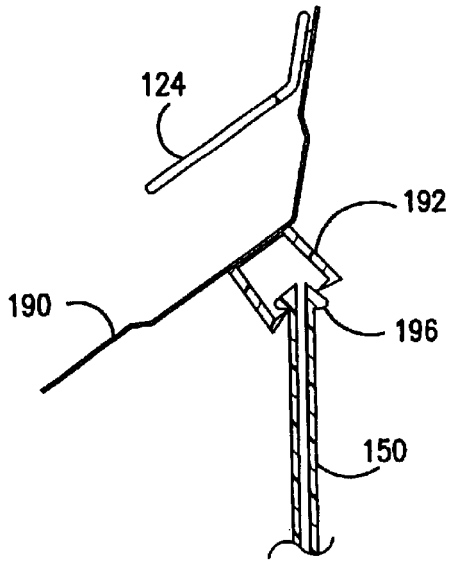
FIG. 3A is a side view detail cross-section of the upper portion of the mechanism of FIG. 3, demonstrating disassociation of the parts.
Figure 3B:
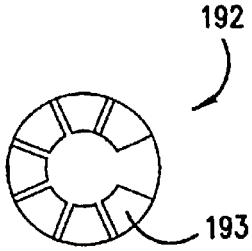
FIG. 3B is a bottom view of the lid socket shown as depicted in FIG. 3A.
Figure 3C:
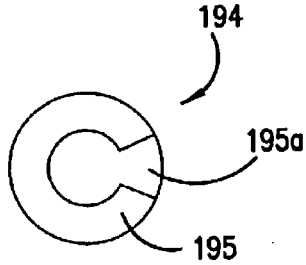
FIG. 3C is a bottom view of another variation of the lid socket shown in FIG. 3A.

FIG. 3A illustrates the top 190 separated from the container 100, and now further deliberately bent back so as to cause the aforementioned female socket member 192 of top 190 to disassociate from the dart 196 of the connector rod 150. FIGS. 3B and 3C are bottom views of alternative female socket members 192 and 194, which can be utilized with the mechanism of FIG. 3 as well as other embodiments. The socket members 192 and 194 illustrated in FIGS. 3B and 3C provide for the easy, but selective, disassociation of the connector rod 150 at its dart end 196 from the top 190. In FIG. 3B the retaining apparatus of the socket member 192 is preferably made up of flexible flaps 193, forming a nearly circumferential flange. With reference now to FIG. 3C, there is illustrated an alternative socket member 194, which differs from the socket member 192 of FIG. 3B in that there is a flexible flange portion 195, which is unsegmented, but has an opening or gap 195A therein to allow the dart 196 to be removed. The thickness and width of the flange and its configuration can all be selected to control the amount of effort required to separate the top from the connecting rod.

Figure 3E:
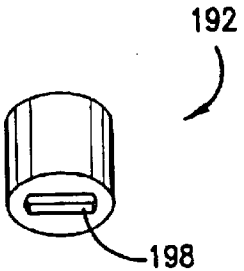
FIG. 3E is a bottom perspective view of a detail of the component socket part of the assembly of FIG. 3D.
Figure 3F:
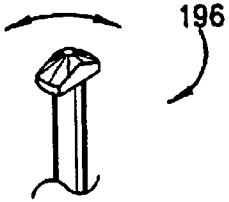
FIG. 3F is a top perspective view of the component dart part of the assembly of FIG. 3D.
Figure 3D:
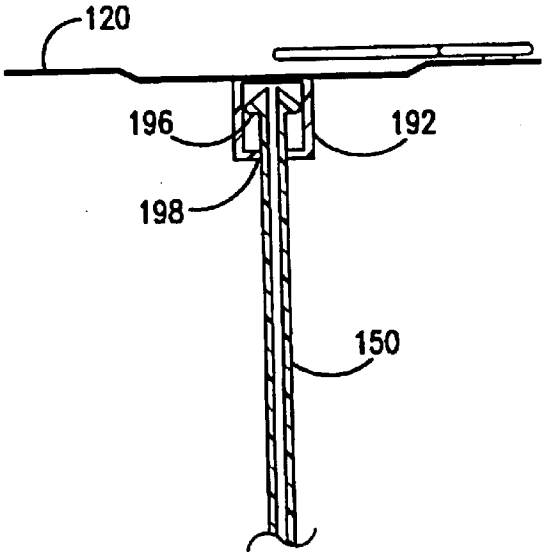
FIG. 3D is a cross-sectional side view detail of a variation of the second embodiment of the content lifting assembly shown in FIG. 3.

FIGS. 3D, 3E, and 3F show component parts of an alternative second embodiment of the mechanism of FIG. 3 in that the dart 196 is captured within the female socket member 192 until such time as the dart 196 is rotated into alignment with a slot opening 198 within the female socket 192, at which time the top 120 can easily be separated from the connector rod 150 as the dart 196 passes freely through the slot 198 and out of the female socket member 192. It should, of course, be understood that the dart 196 in this embodiment would be flattened along one direction and have a thickness no greater than the slot opening 198, allowing passage therethrough. The dart, when not so aligned, would have a thickness greater than the slot opening 198, preventing passage therethrough until proper alignment.

Figure 4:
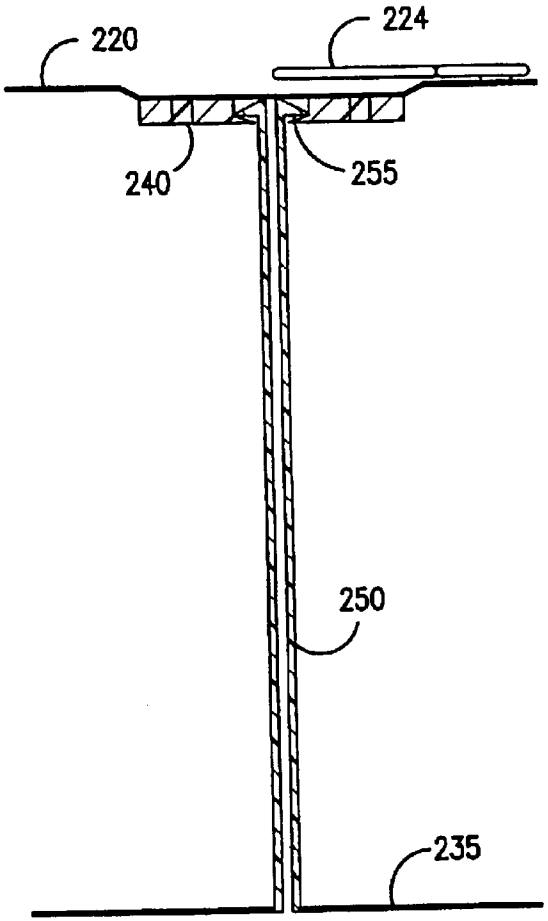
FIG. 4 is a side view in cross-section of a third embodiment of the present invention.
Figure 4A:
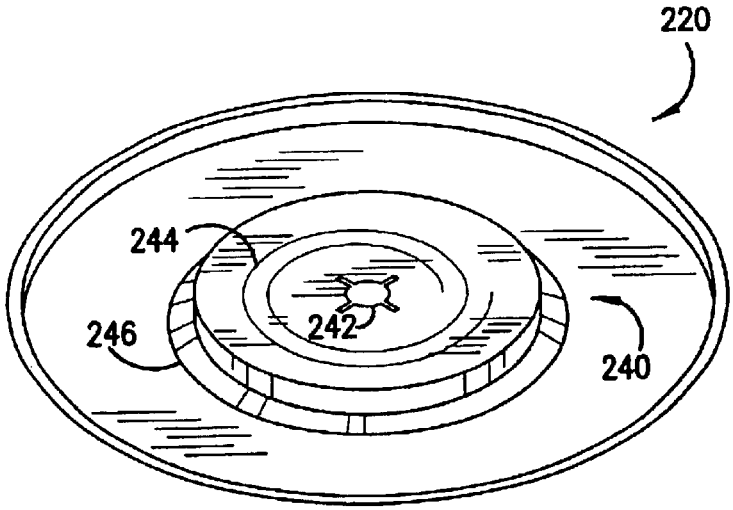
FIG. 4A is a top perspective view of the container top of FIG. 4 which has been flipped over to show additional detail.
Figure 4B:
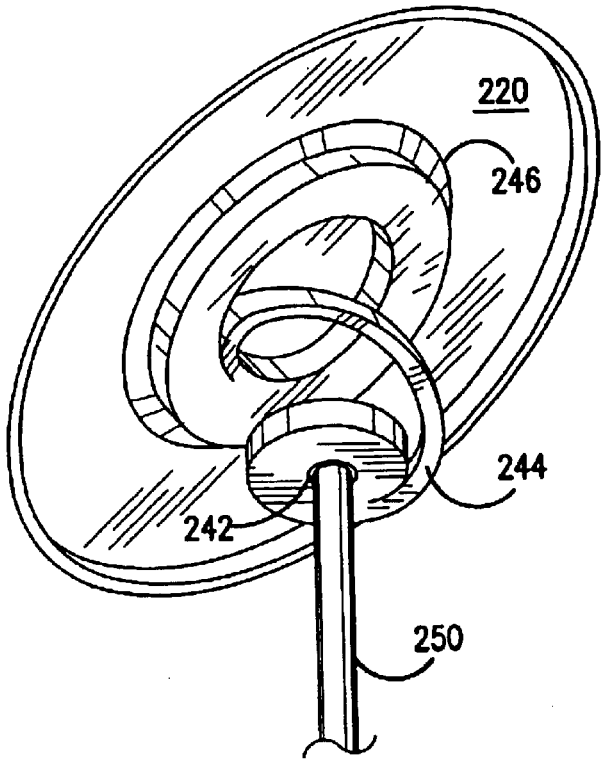
FIG. 4B is a bottom perspective view of a portion of the assembly of FIG. 4 as the lid portion of the top is separated from the container.

With reference now to FIGS. 4, 4A, and 4B there is illustrated a third embodiment of a container assembly in accordance with the teachings of the present invention and generally referred to by the reference numeral 200. FIG. 4 is a cross-sectional view of a top 220 and an internal mechanism utilized in this embodiment. It can be seen that support plate 235 has a flat profile in the side view. It should be noted again, however, that the support plates of the present invention may in general have a wide number of configurations so as to be suitable for the intended purpose. That is, the support plates may be of one layer or more than one layer, relatively solid or perforate, and need not be circular but may have any outline suitable for the intended purpose. Similarly, the support plates may be made of any material suitable for the intended purpose, including but not limited to plastics and metals. The support plate 235 in the embodiment shown in FIG. 4 is connected to a one-piece connector rod 250, which terminates in a dart 255 that is snap-fit engageable within a female receiving socket assembly 240 having a central opening 242, a peripheral coil 244 and an outer rim 246. This socket assembly 240 is attached to the underside of the top 220.

FIG. 4A is a view of the bottom surface of top 220 turned over so that it now faces upward for better illustration and description. It can be appreciated that the lower surface of the top 220 has affixed thereto a coiled female socket assembly 240 with a snap-fit opening 242. As shown in FIG. 4, dart 255 is engageable within the socket assembly 240 adjacent the snap-fit opening 242. If a pull ring 224, as shown in FIG. 4, is utilized to open the container 200, then the top 220 will be removed at an angle, as shown in FIG. 4B. While not an absolute requirement, it is preferable that the top 220 be completely separated from the container 200 before a lifting force is imposed on the contents to make separating the top from the container easier. Referring again to FIG. 4B, as the top 220 is lifted upward and away from the container (not shown) the connector rod 250 stays in mechanically interlocking articulation within the snap fit assembly 240, while the peripheral coil 244 of the snap-fit assembly extends or unfurls. It can be appreciated that the outermost segment of the coil 244 defines the aforementioned outer rim 246, which is firmly attached to the underside of the top 220 so as to retain continuity between the top and the lifting mechanism itself.

It should be understood that the mechanism of joining the outer rim 246 of the snap-fit assembly 240 to the lower surface of the top 220 may be any means effective for the intended purposes including, but not limited to, a mechanical interlock of the two pieces, the use of a glue or adhesive agent, or the use of a plastic material that allows the outer rim 246 to be hot-glued or melted to the lower surface of the top 220. This last technique may be particularly attractive as the heating of the container and the contents is a common practice in the canning process. Alternatively, the top 220 could be formed so as to have a rim or ledge into which snap-fit assembly 240 could itself snap-fit such that while the coil 244 internal to the outer rim 246 could unfurl, the outer rim 246 would remain affixed to the under surface of the top 220. While this embodiment of the present invention is shown as utilizing an essentially cylindrical coil, it should be understood that the invention is in no way limited thereby, and the unfurling portion of the mechanism attaching the top to the connector rod could assume any of a number of configurations so long as suitable for the intended purpose.

Figure 5:
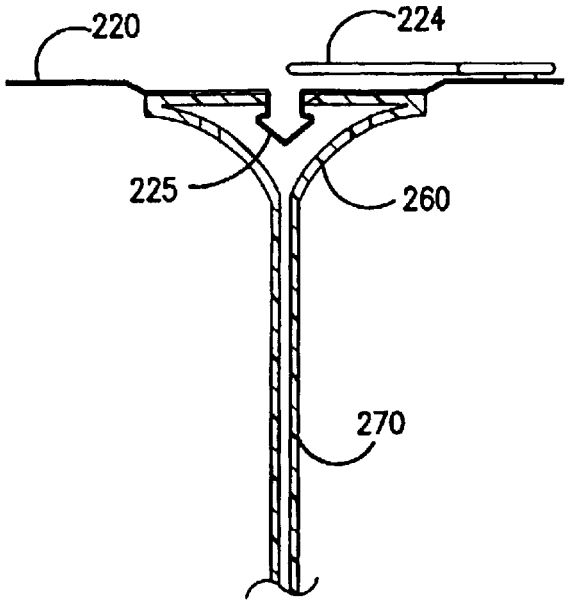
FIG. 5 is a side view in cross-section of a variation of the third embodiment of the present invention showing a portion of the mechanism.
Figure 5A:
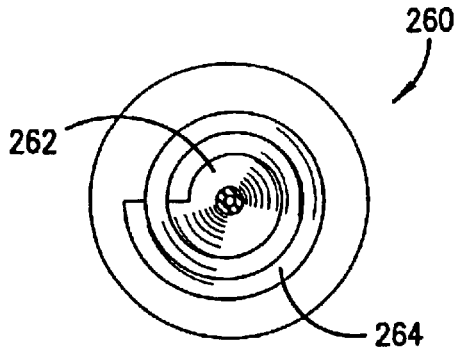
FIG. 5A is a top view of the portion of the assembly of FIG. 5.
Figure 5B:
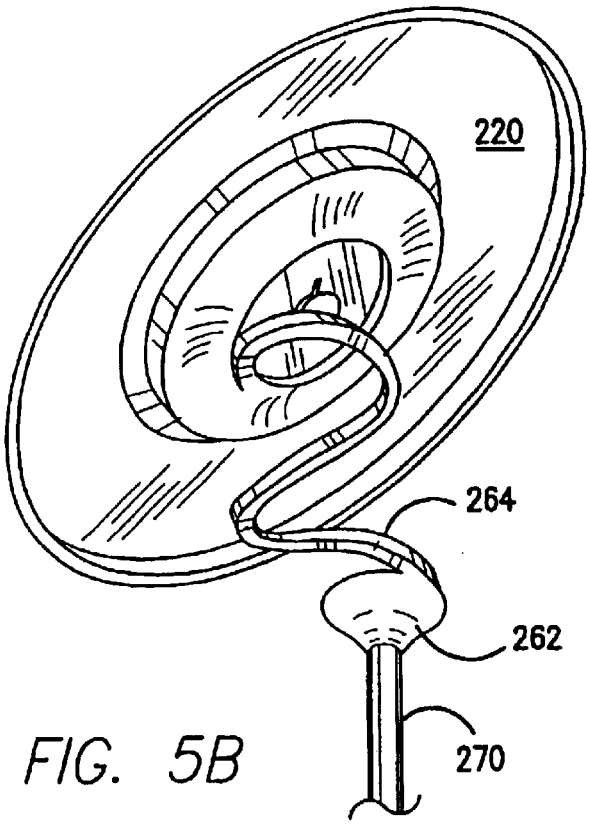
FIG. 5B is a bottom perspective view of the mechanism of FIG. 5 in use when the lid portion of the top is being separated from the container.

With reference now to FIGS. 5, 5A, and 5B, there is illustrated an alternative third embodiment of the present invention that, while similar to the embodiment of FIG. 4, shows a reversal of the snap-fit configuration, such that the top 220 has a male snap-fit engagement assembly 260 and lid dart 225 that engages a female snap-fit connector rod 270. It should be understood by those skilled in the art that this mechanically interlocking articulation is of itself sufficient to secure the components together, and eliminates the need for hot gluing or any adhesive. FIG. 5A is a bottom view of the upper end of the lifting mechanism, including the male snap-fit assembly 260, and the connector rod 270. As seen in FIG. 5B, when the top 220 is lifted and separated from the container (not shown), a central dart 262, attached to the connector rod 270, is free to separate by the unfurling of a coil 264, which remains attached to the top 220 circumferentially by way of the lid dart 225. It should be understood that other variations of the embodiments demonstrated in FIGS. 4 and 5 are possible, and should be considered as part of the present invention.

Figure 6:
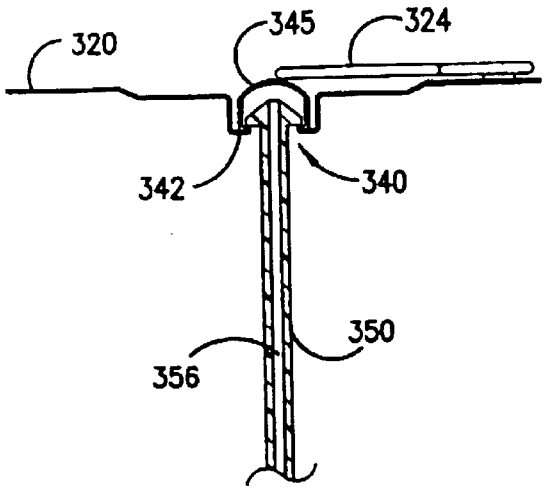
FIG. 6 is a side view in cross-section of a further variation of the present invention useful with various embodiments of the container of the present invention.
Figure 6A:
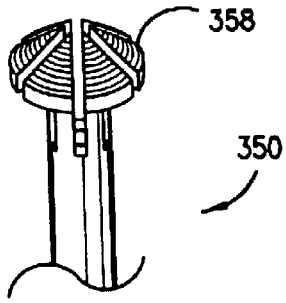
FIG. 6A is a magnified top perspective view of a dart of the present invention useful with various embodiments of the container of the present invention.

FIGS. 6 and 6A show further alternatives applicable to various embodiments of the present invention, and generally designated herein by the reference numeral 300, of the present invention utilizing a male/female snap-fit articulation for a connector rod 350 with a dart head and a top 320 having a formed female receiving socket 340. Dart-headed rod 350 has an air channel 356 therethrough and flexible segments 358, shown in FIG. 6A, separated by slots that allow the dart head to be compressed so as to fit past flanges 342 of receiving socket 340 on the underside of top 320 so as to achieve mechanically interlocking articulation. In this embodiment of the present invention, the top 320 also has a dome portion 345 contiguous with the flanges 342, such that once the top has been separated from the container 300, the user can continue to lift up on a pull ring 324 and simultaneously press down on the dome portion 345 of the top so as to facilitate the extraction of the top 320 from the connector rod 350 should that be desired. Other variations of a "push button" means for separating the top from the lifting mechanism are possible and should be considered as part of the present invention.

Figure 7:
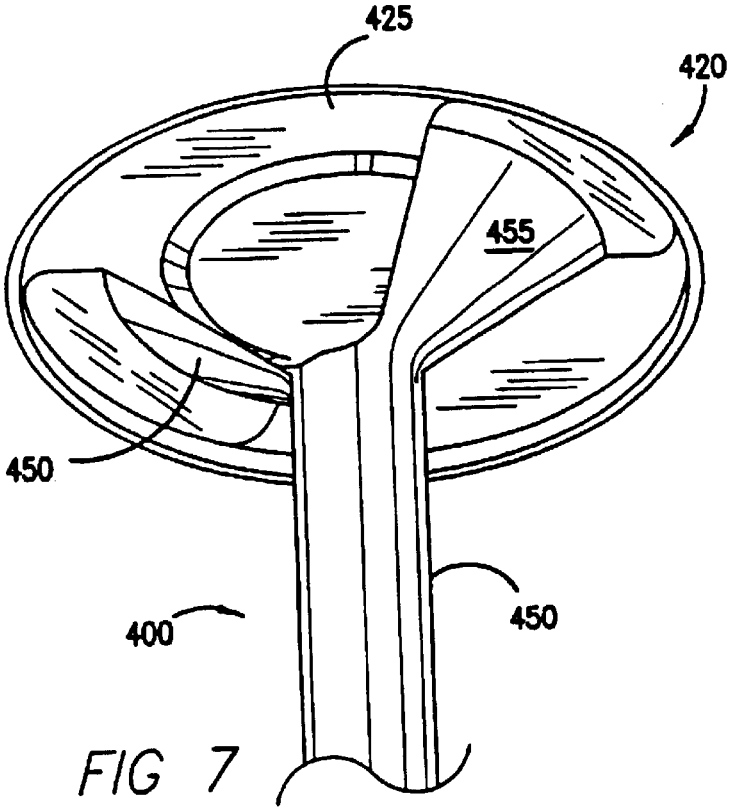
FIG. 7 is a bottom perspective view of a fourth embodiment of the present invention showing the junction of the shaft to the top cover through connecting portions.

With reference now to FIG. 7, there is illustrated a fourth embodiment of a lifting assembly, generally designated by the reference numeral 400, of the present invention, in which a connector rod 450 terminates into a number of post extensions 455 that flair out and attach to the interior surface of a top 420. The connector post 450 and/or extensions 455 could be corrugated to provide for greater flexibility or the capacity to elongate so as to facilitate separation of the lid prior to the lifting of contents of the container. It should be understood, however, that the present invention is not limited to post extensions specifically. The extensions 455 which are forced apart by the top 420 will press against the undersurface of top 420 and can be joined to the top undersurface by a hot glue weld as in the process of heating the can for pasteurization, for example. Alternatively, the top 420 may have a folded metal edge or flange 425 thereabout, which may be continuous or periodically interrupted extending inward from the periphery of the underside of the top 420. It should also be understood that the post extension portions 455 may extend beneath the edge 425 so as to be between the flange and the lower surface of the top itself. Accordingly, when the top 420 is sealed to the container 400, the upper rim of the container wall 410 will press against the flange 110 so as to trap the extension portions 455 between the flange and top, and thereby attach the post extensions 455 and in turn the connector rod 450 to the top 420.

Figure 8:
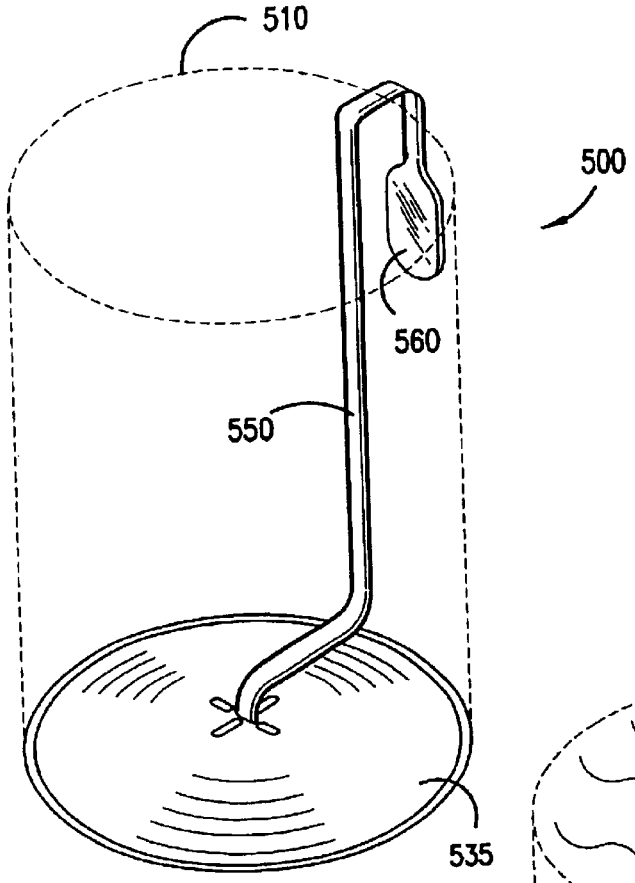
FIG. 8 is a cut-away perspective side view of a fifth embodiment of the present invention.
Figure 8A:
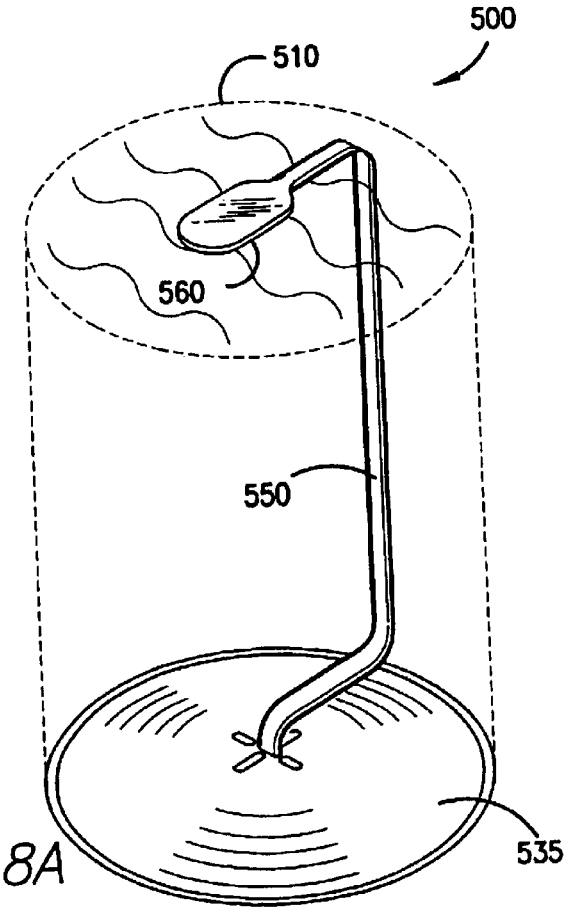
FIG. 8A is a cut-away perspective side view of the container of FIG. 8 after being filled with content material.

FIGS. 8 and 8A are perspective side views of a fifth embodiment container assembly, generally designated by the reference numeral 500, of the present invention with the outlines of the container side walls 510 indicated by dotted lines. It can be appreciated that the container of FIG. 8, prior to being filled, has in place a support plate 535, which may have any configuration suitable for its intended purpose, including circular or noncircular, solid or perforated. Support plate 535 is affixed to connector strap 550, which is preferably contiguous with the support plate 535 and which passes along and over the upper edge of the container wall 510, terminating in an attachment tab 560. It can be appreciated that the support plate 535, the connector strap 550, and the attachment tab 560, by adhering to or following the container surfaces, are completely out of the way of container filling processes, such that the filling of the container, can be performed unimpeded. Once the container has been so filled, as shown in FIG. 8A, the attachment tab 560 is then folded back so as to lie prominently atop the contents within the container 500. The top (not shown) would then be attached to the container 500 in the routine manner and as the container is heated for routine sterilization, the attachment tab 560 could be "hot glued" or otherwise adhesively attached to the interior surface of the top, as is readily apparent to those skilled in the art. Note that by lifting the top, the connector strap 550 is pulled through the contents to the center of the container before lifting can begin. Thus, an air channel is created from the top to the bottom of the container and potential vacuum formation is averted.

Figures 9, 9A, 9B, 18:
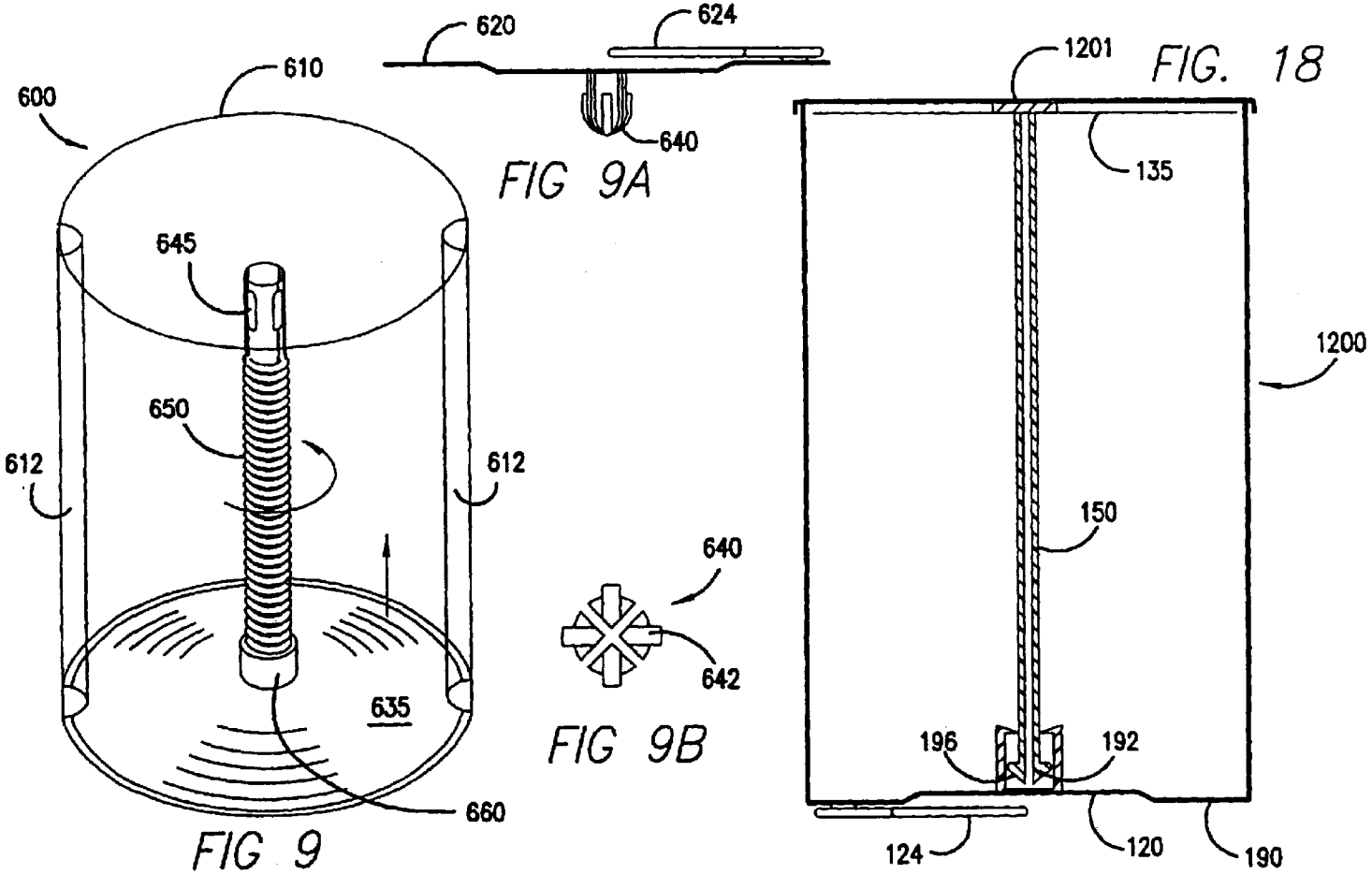
FIG. 9 is a side perspective view of a sixth embodiment of the present invention showing the sidewall of the container in outline.
FIG. 9A is a side view of the top cover and the connector-engaging portion of the mechanism of the apparatus shown in FIG. 9.
FIG. 9B is a bottom view of the connector engaging portion of the embodiment shown in FIG. 9A.
FIG. 18 is a cross-sectional side view of a ninth embodiment of the container content lifting mechanism of the present invention.

With reference now to FIGS. 9, 9A, and 9B, there is illustrated a sixth embodiment container assembly, generally designated by the reference numeral 600, of the present invention. FIG. 9 is a side perspective view with a container wall 610 indicated by dotted lines, revealing a portion of the present invention mechanism. It can be appreciated that the alternative container 600 of this embodiment features longitudinal wall indents 612. A support plate 635 has a female threaded portion 660 engaged to a threaded shaft 650 which in this embodiment serves as the connector between the support plate 635 and the top 620, as shown in FIG. 9A. The top embodiment illustrated in FIG. 9A has a male dart portion 640 for snap-fitting into an upper portion of the threaded shaft 650, such that a number of flexible dart portions 642 separated by slots, as seen in the bottom view of the male dart 640 in FIG. 9B, are able to be engaged into a commensurate number of openings 645 within the uppermost portion of the threaded shaft 650. This allows a snap-fit between the top 620 and the connector shaft 650 that is capable of rotational stability, such that the top 620 can then be used to rotate the threaded shaft.

The illustration of this embodiment, in which the mechanically interlocking articulation between the top and shaft are shown as snap-fit and the particulars of which side is male and which side female, are by way of example only and not limitation as is true for this teaching as regards all applicable embodiments. Other means of achieving mechanically interlocking articulation between the top 620 and the shaft 650, and allowing for rotational stability are possible and should, therefore, be considered as part of the present invention. In use, container, 600 would have the support plate 635 and the threaded shaft member 650 articulated and in place within in the container as shown in FIG. 9 prior to filling the container. After the container 600 is filled, the top 620 would then be pressed down onto the container, at which point the male snap-fit dart member 640 would be driven into the threaded connector openings 645 within the uppermost portion of the shaft 650, such that the flexible dart members 642 would be compressed as the male dart 640 entered the connector 650, and then the flexible dart members 642 would, when allowed by the openings 645, expand and protrude through the slots 645 so as to engage the two parts together. The top 620 would then be sealed to the container 600 around the periphery in the usual manner.

To open, a pull ring 624 would be lifted so as to initiate the separation of the central portion of the top 620 from the rim and then further be used to separate the top from the container. If some freedom to manipulate the top prior to the lifting of the contents were desired, then the extending dart portions 642 could be of a lesser length than the receiving slots 645 within the threaded shaft 650 to allow for some up and down motion of the dart 640 within the shaft 650. Greater motion still could be achieved by allowing the threaded shaft 650 to be formed of a flexible material. Once the top 620 is separated from the container 600 the user would utilize the pull ring 624, which had been lifted from the top itself so as to extend at an angle, to rotate the threaded shaft 650 causing the support plate 635 to rise upward within the container as it would not be free to rotate constrained by the longitudinal indents 612 corresponding to the cut-out portions of the plate 635. In a preferred variation of this embodiment, the thread would have a multi-point lead such as a four point or eight point lead, such that it would be possible to raise the support plate 635 the entire length or height of the container with but a few rotations. It should also be understood that the movement of the plate 635 relative to the number of rotations of the top could be adjusted, such that each full turn of the top 620 could, by way of example and not limitation, raise the support plate 635 approximately one-quarter of the length of the container 600.

Figure 10:
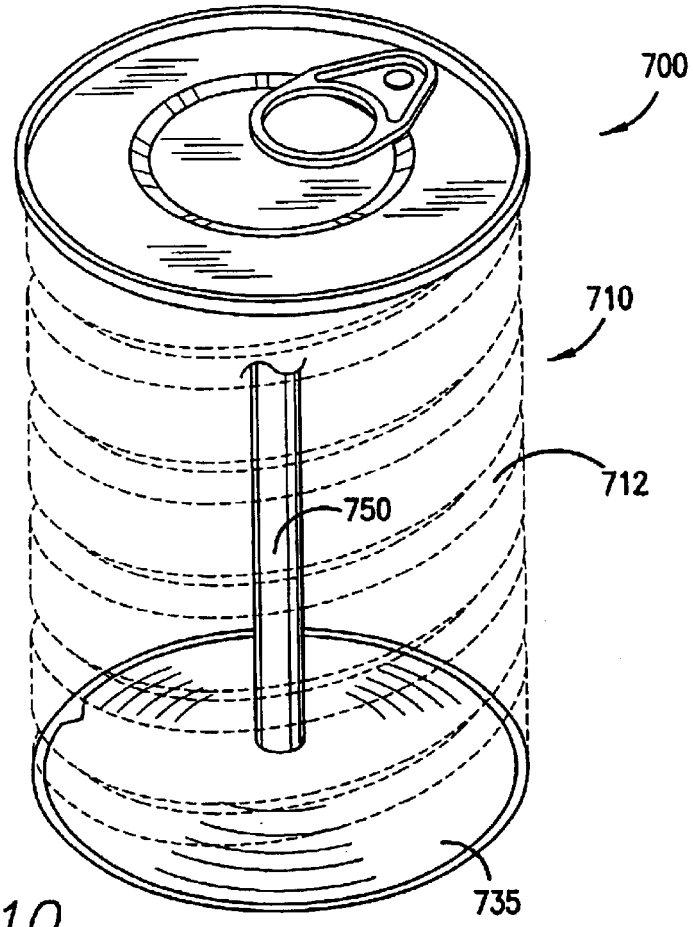
FIG. 10 is a side perspective view of a variation of the sixth embodiment of the present invention showing the sidewall of the container in outline.
Figure 10A:
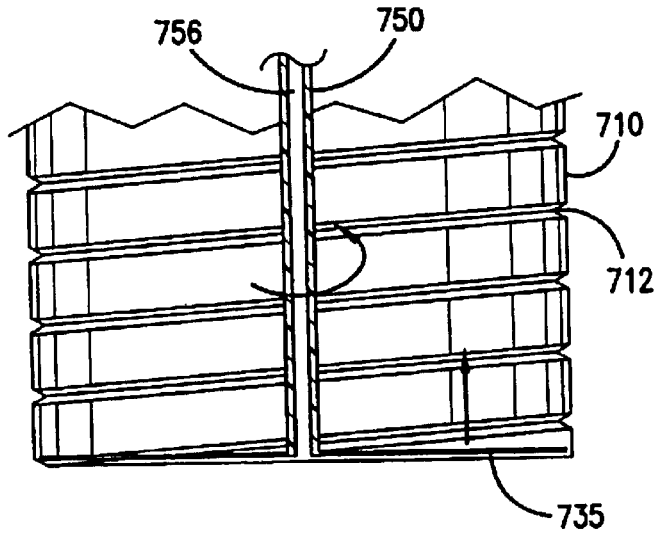
FIG. 10A is a detail side view and partial cross-section of the container and mechanism shown in FIG. 10.

With reference now to FIGS. 10 and 10A, there is illustrated an alternative fifth embodiment container assembly of the present invention, generally designated herein by the reference numeral 700, similar to that illustrated and described in connection with FIG. 9. Alternative container 700 has a helical thread 712 formed along an internal wall 710 of the container. A support plate 735 is engaged to the container wall helical thread 712 such that, when a connector rod 750 is rotated, the support plate 735 climbs upward. FIG. 10A is a side view and cross-sectional detail of the lower portion of the present embodiment, indicating the presence of an air channel 756 passing through the connector rod 750 with an opening in the support plate 735 and at the upper rod end (not shown) to allow for the passage of air from above the contents to below the support plate 735, thereby preventing the formation of a vacuum as the contents are moved upward. Although the presence of such an air channel in this and the various other embodiments of the present invention is considered desirable, it should nevertheless be understood that the invention is not to be considered limited to designs incorporating such a feature.

Figure 11:
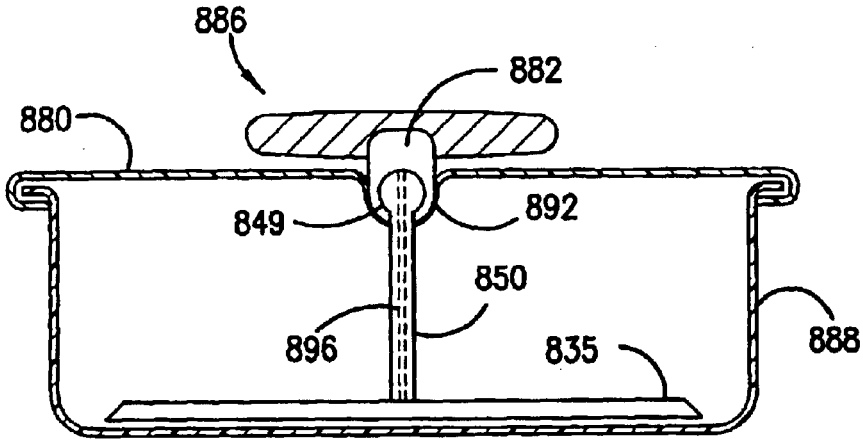
FIG. 11 is a side view in cross-section of a variation of the second embodiment of the present invention.

With reference now to FIG. 11, there is illustrated a variation of the second embodiment container of the present invention, generally designated by the reference numeral 800. Container 800 suitably comprises a plastic material and has a top 880 comprising of a flexible plastic material which is capable of repeatedly being separated from, and resealed to the remainder of the container 800 portion by complimenting flexible flanges. Knob 886 has a socket 882 with a flange 892 for articulating with the connector post end 845 having air passage 896. The flexibility of the top 880 combined with the depth of the socket 882 relative to the post end 845 allows for the top to be separated from the remainder of the side wall of the container prior to the lifting of the contents. As an alternative, the connector post may be corrugated such that it can be collapsed to reduce its overall length similar to the corrugations typically found in drinking straws having a curvable end. When the collapsible connector post is attached to the underside of the top, at least a portion of the top may be separated from the container as the connector extends from its collapsed state without lifting the contents of the container.

Figure 12:
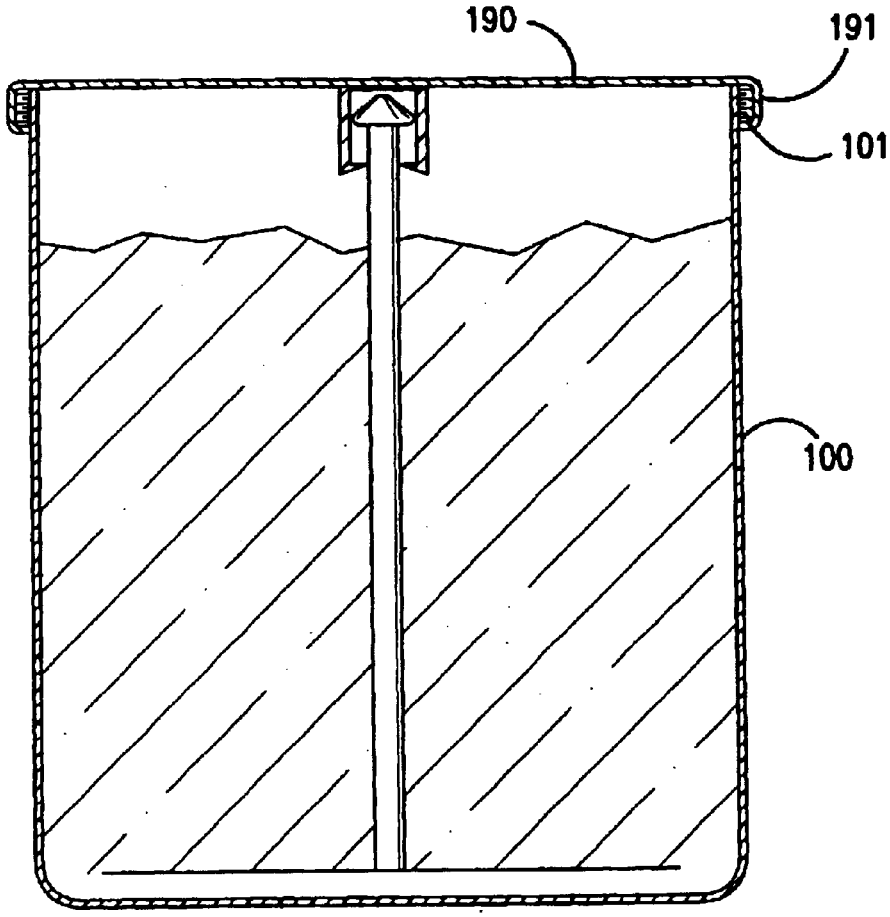
FIG. 12 is a side view in cross-section of an alternative second embodiment container featuring a threaded screw top and a glass jar.

With reference now to FIG. 12, there is illustrated an alternative second embodiment of the container 100 of the present invention, as for when the container 100 comprises a glass jar with a reusable screw top 190. In this alternative embodiment, top 190 has an inwardly threaded flange 191 which is designed to engage an outwardly threaded surface 101 at the uppermost exterior surface of the container 100. This screw top design is applicable to many cylindrical container embodiments and is understood to encompass all such embodiments, not merely the particular embodiment shown in FIG. 12 provided by way of example.

Figure 13:
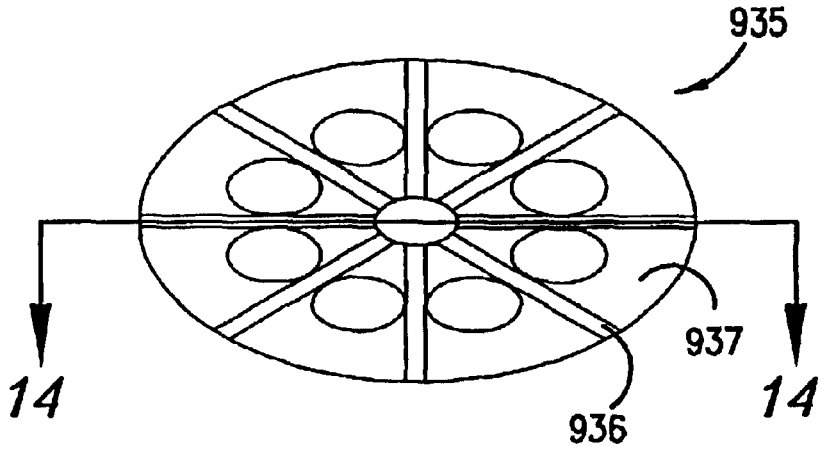
FIG. 13 is a top plan view of an alternative lifting assembly featuring vertical partitions useful with various embodiments of the present invention.
Figure 14:
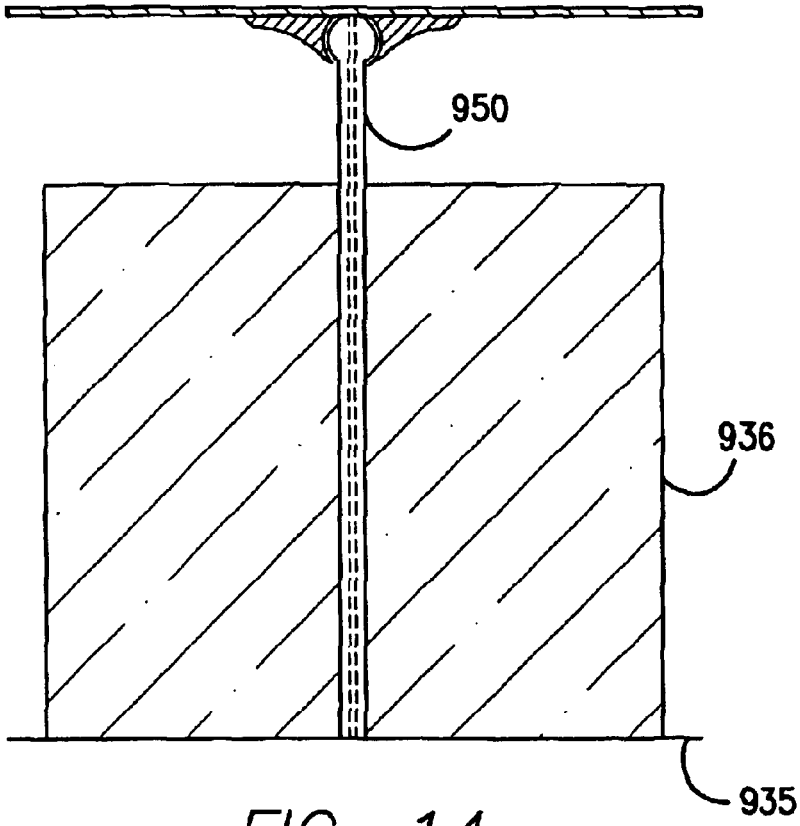
FIG. 14 is a cut-away side view along line 14—14 of FIG. 13 of a lifting assembly of the present invention.

Turning now to FIGS. 13 and 14, there is illustrated a variation of the present invention useful with various embodiments of the container described herein, generally designated by the reference numeral 900. The support plate/connector 935 features vertical partitions 936 which extend upward from the support plate and/or outwardly from the connector and serve to partition the interior of the container 900 into sections 937. It should be understood that the partitioned support plate 935 in this embodiment allows items or materials within the container 900 to remain separated and vertically aligned as would be useful for pickles. It should further be understood that compartments can be obtained by horizontally stacking a plurality of partitioned support plates 935 and attaching them to a single connector 950. Obviously, the alternative support plate shown hereinabove is not limited to a single embodiment, but rather can be made in virtually any shape or configuration suitable for dividing a container into two or more separate compartments.

Figure 15A:
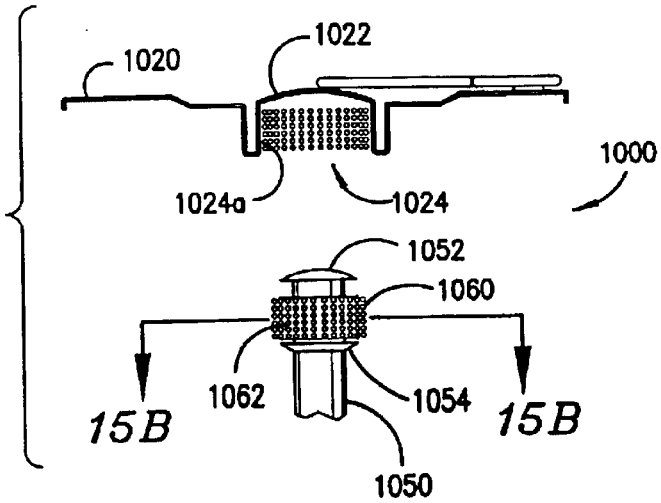
FIG. 15A is a detail side view of a seventh embodiment of the present invention.
Figure 15B:
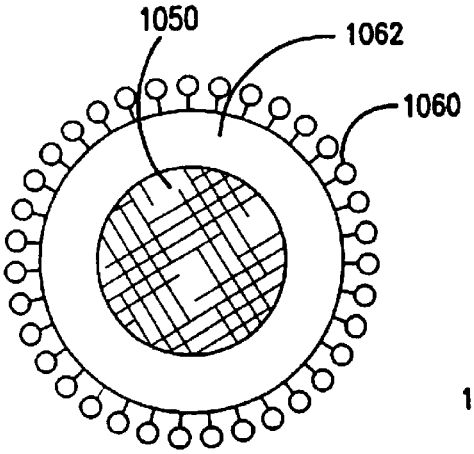
FIG. 15B is a detail top view of the connector of the seventh embodiment of the present invention.
Figure 15C:
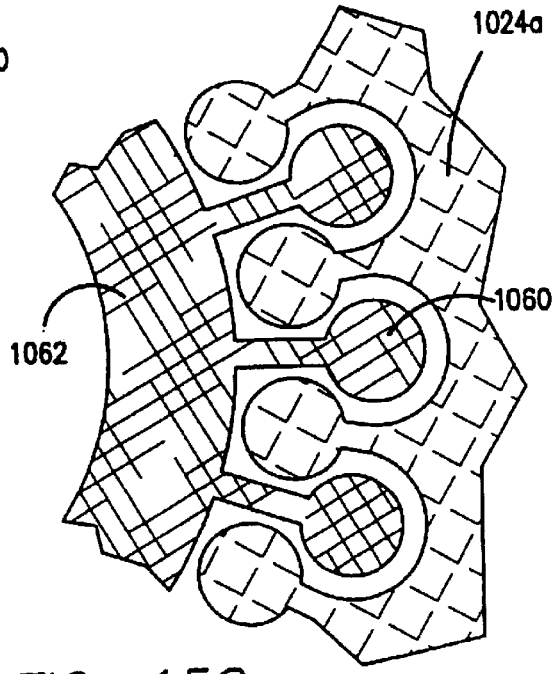
FIG. 15C is a detail of the interlocking articulation of FIG. 15B.

With reference now to FIGS. 15A, 15B, and 15C there are illustrated component parts of a seventh embodiment container, generally designated by the reference numeral 1000, of the present invention in an unassembled state. A connector rod 1050 has a flanged portion 1052 at an end thereof, as shown in FIG. 15A and a support stop 1054 proximate flanged portion 1052 at the end. A slip ring 1062 with an outwardly facing interlock surface 1060 engages the connector rod 1050 between the flanged portion 1052 and the support stop 1054 and is secured therebetween. The interlock surface 1060 of slip ring 1062 is made of any number of materials preferably inert, non-absorbent and non-metallic, e.g., plastics.

With further reference to FIG. 15A, a top 1020 is shown with a circular indentation 1024 forming a dome portion 1022 and internally forming a socket 1024 having a size and shape adapted to receive the slip ring 1062 with the connector rod 1050 with a interlock fit. Shown along the side walls 1024A of the socket of top 1020 are materials for interlocking with the slip ring 1062. As shown in FIG. 15A, socket 1024 preferably has a sufficient depth so that the connector rod 1050 has free space to move up and down therein, also allowing angulation and rotation of the connector rod 1050. The interlock as described is achieved by interlocking of the surfaces such as by complimentary knurlings or posts or posts with heads as shown in detail in FIG. 15C.

During assembly, the top 1020 is pressed down, onto the connector rod 1050, and the slip ring supported by flange 1054 is forced into the socket 1024 such that the opposed interlocking surfaces engage. It should be understood that the slip ring 1062 may also be hot glued within the socket 1024. FIG. 15B illustrates a top view of the connector rod 1050 shown in FIG. 15A.

Figure 16A:
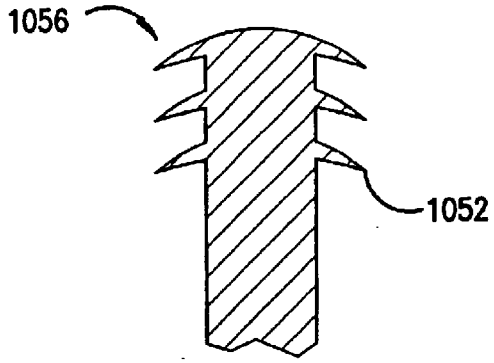
FIGS. 16A and 16B are detail side views of a variation of the lid connector articulation useful with various embodiments of the present invention.
Figure 16B:
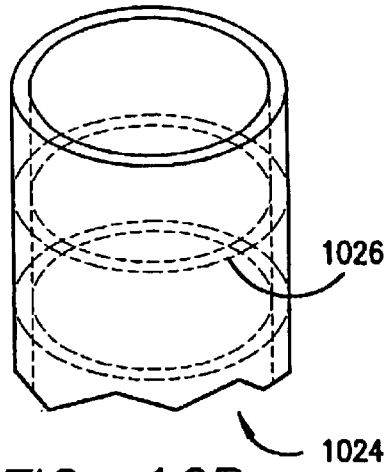

FIGS. 16A and 16B show a variation of a dart socket articulation for use when dart 1056 is made of a flexible plastic such that annular flanges 1052 can be readily deformed to pass into opening 1024 before reexpanding to become captured in grooves 1026. Annular inwardly extended ring could be used in conjunction with or instead of such grooves.

Figure 17A:
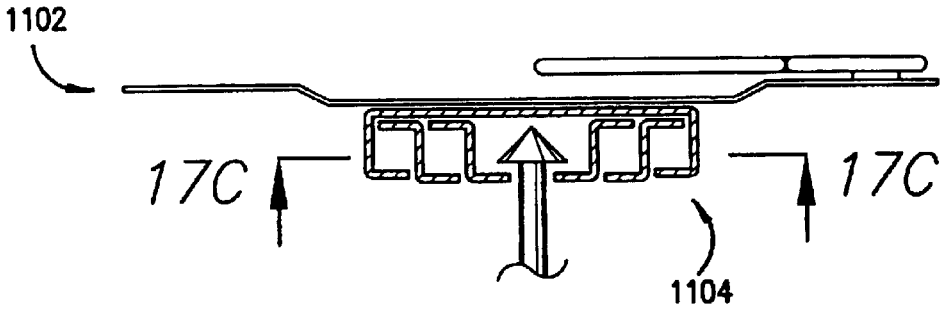
FIG. 17A, is a cross-sectional side view of an eighth embodiment of the present invention in a collapsed position.
Figure 17B:
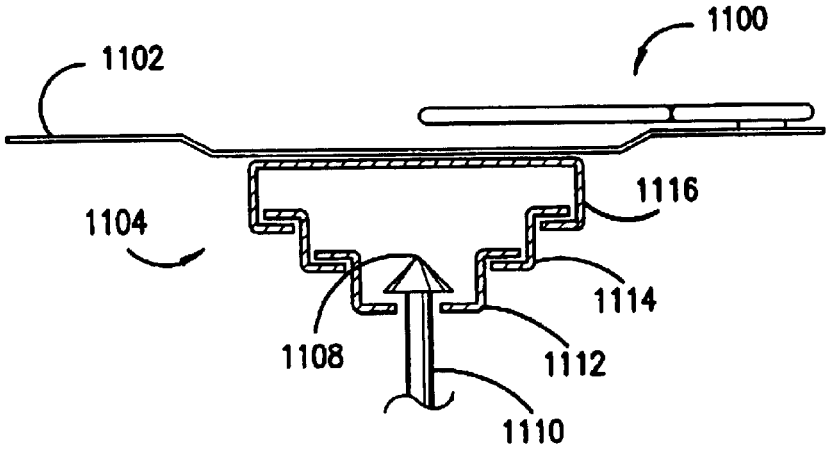
FIG. 17B is a cross-sectional side view of FIG. 17A in an extended position.
Figure 17C:
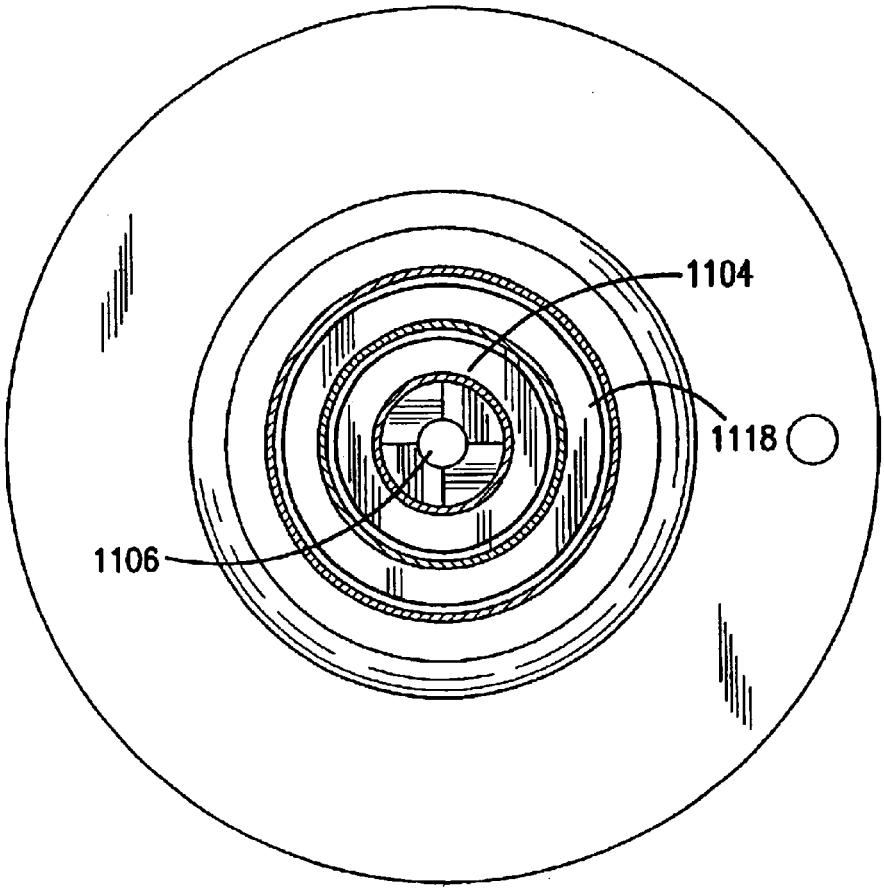
FIG. 17C is a bottom plan view of FIG. 17A in a collapsed position.

Referring now to FIGS. 17A, 17B, and 17C an eighth embodiment of the present invention generally referred to as 1100 is shown. Top 1102 has attached to its lower surface a telescoping socket 1104 having a flanged opening 1106 for receiving the darted end 1108 of a connector rod 1110. As shown in FIG. 17A during the canning procedure, the telescoping socket 1104 comprising of interfitting captured flanged tubular segments 1112, 1114, and 1116 is collapsed and compact. When the top is pressed onto the upper edge of the can wall, the dart end 1108 of the connector rod 1110 is forced into articulation with the socket portion of 1112 through flanged opening 1106. When the can is opened and the lid portion separated from the outer rim of the top the flanged interfitted cylindrical portions 1112, 1114, and 1116, allow for the controlled elongation of socket 1 104 and the dart and socket allow for angulation such that the lid 1118 can be separated fully from the rim of the top prior to the lifting of the contents.

If desired, the lid can be separated from the connector by the previously taught means. And further, as with the prior examples, the support plate can be sized as desired to allow it to either exit the can or to be trapped therein.

With reference now to FIG. 18, a ninth embodiment of the container and content lifting assembly of the present invention is illustrated and generally referred to by the numeral 1200. Container 1200 is useful in an alternative canning process where the container is filled upside down. Regardless of which end is tapped closed in production, the end of the container opposite the support plate 135 is defined as the top 190. Top 190 has an extended, projecting female socket member 192 and connector rod 150 extends from the support plate 135 the length or height of the container 1200, terminating in a dart 196 that is capable of a snap-fit mechanically interlocking articulation within the female receiving socket member 192 attachment to the top 190. The bottom of the container can be attached to support the support plate 135 such that the bottom and the support plate 135 may be held in suitable alignment by a machine applying bottom to the container. The attachment of the support plate 135 to the top 190 may be a light glue or a mild adhesive 1201 such as flour and water, starch, etc., so in canning the fluids plus or minus heat dissolve the weak bond.

When the bottom is applied with attached support plate 135, the connector 150 is forced at its other end into engagement with the lid portion of the top 190. When the top 190 is opened, the support plate is pulled free of its weak attachment to the bottom. Alternatively, the support plate and connector unattached to the bottom can be inserted, followed by the bottom.

While the present invention has been described in detail with regard to the preferred embodiments, it should be appreciated that other variations of the present invention may be devised which do not depart from the inventive concept and scope of the present invention.

What is claimed is:

1. A container comprising:

a top having an interior surface and an exterior surface, a bottom, and at least one side wall forming a complete perimeter between said top and bottom, said top, bottom, and side wall forming an airtight enclosure;

a support plate for supporting and lifting contents contained within said container, said support plate adapted to be placed within said container and proximate said bottom, said support plate being movable within said container in a direction between said bottom and said top;

a connector for connecting said top and said support plate when said support plate is located proximate said bottom, said connector having a first end and an opposite second end, said first end being engaged to one of said top and said support plate and said second end being engaged to the other of said top and said support plate, at least one of sold first and second ends being configured to cooperatively engage at least a portion of one of said top and said support plate; and at least a portion of said top, said connector, and said support plate arranged to form a lifting assembly for lifting contents from within said container.

2. The container of claim 1, wherein at least one of said first and second ends of said connector form a mechanically interlocking articulation with one of said top and said support plate.

3. The container of claim 2, wherein said mechanically interlocking articulation Is between said connector and said support plate.

4. The container of claim 2, wherein said connector has a first portion and a second portion and said mechanically interlocking articulation includes a reciprocating connection of said first and second portions of said connector.

5. The container of claim 2, wherein said mechanically interlocking articulation includes complimentary interlocking surfaces.

6. The container of claim 2, wherein said mechanically interlocking articulation further comprises an unfurling portion between said connector and said interior surface of said top, said unfurling portion capable of being unfurled without becoming disconnected from said top and said connector when said removable portion of said top is separated from said container.

7. The container of claim 2, wherein said mechanically, interlocking articulation includes female and male cooperating coupling portions associated with said connector and said interior surface of said top.

8. The container of claim 2, wherein said mechanically interlocking articulation includes a male portion and a female portion cooperatively engaged and capable of moving relative to each other without becoming disconnected from said top and said connector when a removable portion of said top is separated from said container.

9. The container of claim 8, wherein said female portion is a socket with a narrowed entrance and said male portion is configured to be passable into said socket and in cooperation with said narrowed entrance to remain contained within said socket for lifting the contents of said container.

10. The container of claim 8, wherein said female portion is dimensioned to have an interior depth greater than the length of said male portion to allow for said male portion to be moveable within said female portion.

11. The container of claim 2, wherein said mechanically interlocking articulation is configured to be articulated and disarticulated.

12. The container of claim 2, wherein said mechanically interlocking articulation is configured to be re-articulated after being disarticulated.

13. The container of claim 1, wherein said connector is at least in part a flexible member.

14. The container of claim 1, wherein said connector includes a rod.

15. The container of claim 1, wherein said connector includes an air channel for conducting air through the contents of the container and to beneath said support plate.

16. The container of claim 1, further comprising a replacement cover for replacing at least a portion of said top after said container has been opened, said replacement cover having a bottom surface configured for articulating with said connector to manipulate the contents of said container.

17. The container of claim 16, wherein said replacement cover includes a circumferential flange for engaging and resealing said container.

18. The container of claim 1, wherein said top, said connector, and said support plate cooperate to allow for angulation of a removable portion of said top sufficient to allow separation of said removable portion from said container prior to lifting the contents from within said container.

19. The container of claim 18, wherein said angulation s provided for at least in part by the cooperative engagement between said at least one of said first and second ends and said at least a portion of one of said top and said support plate.

20. The container of claim 18, wherein said angulation is provided for at least in part by said connector.

21. The container of claim 1, wherein said top, said connector, and said support plate cooperate to allow for displacement of a removable portion of said top sufficient to allow separation of said removable portion of said top from said container prior to lifting the contents from within said container.

22. The container of claim 1, wherein said container is one of a can and a jar.

23. The container of claim 1, wherein said support plate is configured to allow drainage of fluids when lifted.

24. The container of claim 1, wherein said support plate is dimensioned to hug the Inner surface of said side wall.

25. The container of claim 1, wherein said support plate has an air passage passing therethrough in continuity with an air passage in said connector.

26. The container of claim 1, wherein said top is threadably attachable to said container.

27. The container of claim 1, wherein said top includes a lid portion that is separable from the remainder of said top so as to provide access to the interior of said container after said container has been sealed to form an airtight enclosure.

28. The container of claim 1, wherein at least a lid portion of said top can be separated from the remainder of said top prior to said lifting assembly lifting the contents within said container.

29. The container of claim 1, wherein said side wall includes an internal thread for engaging said support plate, said support plate threadably engaging said internal thread and being rotatable within said container.

30. The container of claim 1, wherein said mechanically interlocking articulation is configured to allow for the filling of contents into said container prior to said top and said support plate being connected.

31. The container of claim 1, wherein the cooperative engagement between said at least one of said first and second ends and said at least a portion of one of said top and said support plate is at least in part resilient.

32. The container of claim 1, wherein the cooperative engagement is formed by a generally spherical-shaped member engaging with a generally spherical recess.

33. The container of claim 1, wherein the cooperative engagement includes a snap-fit connection.

34. The container of claim 1, wherein said connector and at least one of said top and said support plate are detachabley attached to one another.

35. The container of claim 1, wherein said container is configured for use in an automated packaging process.

36. The container of claim 1, wherein said support plate includes partitions for maintaining contents of said container in a selected position relative to said support plate.

37. The container of claim 1, wherein said top is at least in part made of metal.

* * * * *

UNITED STATES PATENT AND TRADEMARK OFFICE

CERTIFICATE OF CORRECTION

PATENT NO. : 7,070,070 B2
APPLICATION NO. : 10/401460
DATED : July 4, 2006
INVENTOR(S) : Gary K. Michelson et al.

It is certified that error appears in the above-identified patent and that said Letters Patent is hereby corrected as shown below:

Column 14, Line 57:
Change "betweer" to -- between --.

Column 15:
Line 5: change "sold" to -- said --;
Line 16: change "Is between" to -- is between --; and
Line 32: change "mechanically," to -- mechanically --.

Column 16:
Line 6: change "angulation s" to -- angulation is --;
Line 24: change "inner surface" to -- inner surface --; and
Line 56: change "detachabley" to -- detachably --.

Signed and Sealed this

Fifth day of September, 2006

JON W. DUDAS
*Director of the United States Patent and Trademark Office*